US010557603B2

(12) United States Patent
Walker

(10) Patent No.: US 10,557,603 B2
(45) Date of Patent: Feb. 11, 2020

(54) EMBEDDED PLATFORM LIGHTS

(71) Applicant: Altec Industries, Inc., Birmingham, AL (US)

(72) Inventor: Elizabeth K. Walker, Wake Forest, NC (US)

(73) Assignee: Altec Industries, Inc., Birmingham, AL (US)

( * ) Notice: Subject to any disclaimer, the term of this patent is extended or adjusted under 35 U.S.C. 154(b) by 38 days.

(21) Appl. No.: 15/956,226

(22) Filed: Apr. 18, 2018

(65) Prior Publication Data

US 2018/0238507 A1 Aug. 23, 2018

Related U.S. Application Data

(63) Continuation of application No. 15/005,723, filed on Jan. 25, 2016, now Pat. No. 9,976,715.

(51) Int. Cl.

| | |
|---|---|
| ***F21S 9/03*** | (2006.01) |
| ***F21S 4/26*** | (2016.01) |
| ***F21V 33/00*** | (2006.01) |
| ***B66F 11/04*** | (2006.01) |
| *F21Y 115/10* | (2016.01) |

(52) U.S. Cl.

CPC ..... *F21S 9/03* (2013.01); *B66F 11/04* (2013.01); *B66F 11/046* (2013.01); *F21S 4/26* (2016.01); *F21V 33/00* (2013.01); *F21Y 2115/10* (2016.08)

(58) Field of Classification Search

CPC ... F21S 9/03; F21S 4/26; B66F 11/046; B66F 11/04; F21V 33/00; F21Y 2115/10

See application file for complete search history.

(56) References Cited

U.S. PATENT DOCUMENTS

| | | | | |
|---|---|---|---|---|
| 6,123,443 | A * | 9/2000 | Conway | F21S 8/032 362/145 |
| 6,328,454 | B1 * | 12/2001 | Davis | A42B 3/044 362/105 |
| 9,149,670 | B1 * | 10/2015 | Walker | A62B 35/0068 |
| 2013/0067829 | A1 * | 3/2013 | Johnstone | E04H 3/26 52/7 |
| 2013/0235564 | A1 * | 9/2013 | Barcelos | F21V 33/006 362/151 |
| 2014/0138183 | A1 * | 5/2014 | Chard | B66F 17/006 182/46 |

* cited by examiner

*Primary Examiner* — Bao Q Truong
*Assistant Examiner* — Glenn D Zimmerman
(74) *Attorney, Agent, or Firm* — Erise IP, P.A.

(57) ABSTRACT

A lighting system is configured to provide lighting on an interior of a utility platform. The lighting system comprises a rope light and a power source for installing in or near the utility platform. The rope light includes a plurality of light emitters and a casing. The casing surrounds the plurality of light emitters, which are spread along the rope light. The rope light is configured to provide light to an interior surface of the utility platform. The isolated power source provides electrical power to the rope light, and is configured to prevent a discharge of electricity.

20 Claims, 8 Drawing Sheets

EMBEDDED PLATFORM LIGHTS

RELATED APPLICATIONS

This patent application is a continuation application claiming priority benefit, with regard to all common subject matter, of U.S. patent application Ser. No. 15/005,723, filed Jan. 25, 2016, and entitled "EMBEDDED PLATFORM LIGHTS." The above-referenced application is hereby incorporated by reference in its entirety into the present application.

BACKGROUND

1. Field

Embodiments of the invention relate to aerial devices and utility platforms. More specifically, embodiments of the invention relate to lighting systems for aerial devices and utility platforms.

2. Related Art

Utility workers utilize an aerial device to reach inaccessible locations. The aerial device generally includes a boom assembly with a utility platform connected to a distal end of the boom. One or more utility workers stand in the utility platform. Utility workers typically use an aerial device to access overhead electric power lines and electric power components for installation, repair, or maintenance. The utility platforms utilized by electric utility workers are highly insulated so as to prevent the discharge of electricity through the utility truck, and especially through the utility worker. Utility workers will also store tools, repair parts, and other objects in the utility platform to be used during the completion of the task.

Utility workers will often work at night, especially in emergency repair situations. Currently, utility workers utilize helmet lights and/or spotlights from the ground to illuminate the work area. Helmet lights provide a limited amount of light and require the utility worker to orient his or her head in order to position the light. This can be awkward or inadequate, especially when the utility worker is reaching within the utility platform. Spotlights from the ground provide adequate amounts of light for illuminating the work area, but are inadequate for lighting the interior of the utility platform. Spotlights from the ground also cast large shadows.

Utility workers operating at night need to access the tools and repair parts stored in the utility platform. Tools or repair parts may also be inadvertently dropped into the utility platform. Tools and repair parts may also be stored in the utility platform by hanging them from a lip of the utility platform. Due to the tight fit in which the utility worker is placed in the utility platform, the utility worker has difficulty orienting their headlamp so as to see within the platform. The inadequate lighting of the interior of the utility platform therefore causes frustration in utility workers.

SUMMARY

Embodiments of the invention solve the above-mentioned problems by providing a lighting system for utility platforms. The lighting system provides light to the interior of the utility platform. The light allows the utility worker to clearly see the interior of the utility platform, especially during nighttime operations. The lighting system is electrically isolated so as to prevent a potentially dangerous discharge of electricity.

A first embodiment of the invention is directed to a lighting system configured to provide lighting on an interior of a utility platform. The lighting system comprises a rope light and a power source for installing in or near the utility platform. The rope light includes a plurality of light emitters and a casing. The casing surrounds the plurality of light emitters, which are spread along the rope light. The rope light is configured to provide light to an interior surface of the utility platform. The isolated power source provides electrical power to the rope light, and is configured to prevent a discharge of electricity.

A second embodiment of the invention is directed to a utility platform assembly. The utility platform assembly broadly comprises a utility platform and a lighting system. The utility platform includes a sidewall and a floor. The utility platform presents a cavity configured to support a utility worker therein. The lighting system, as described above, includes a rope light and a power source. At least a portion of the lighting system is embedded in the utility platform.

A third embodiment of the invention is a method of providing light to an interior of a utility platform. The method comprises the following steps: installing a rope light adjacent to the utility platform, wherein the rope light is configured to emit a light via a plurality of light emitters disposed along the rope light; and installing a power source with the utility platform such that the power source is configured to provide electrical power to the rope light, wherein the power source is electrically isolated so as to prevent a potentially hazardous discharge of electricity.

Yet another embodiment of the invention may be directed to an aerial device, including a base, a boom assembly, and a utility platform with a lighting system therein. Still a further embodiment of the invention may be directed to a method of using the lighting system.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
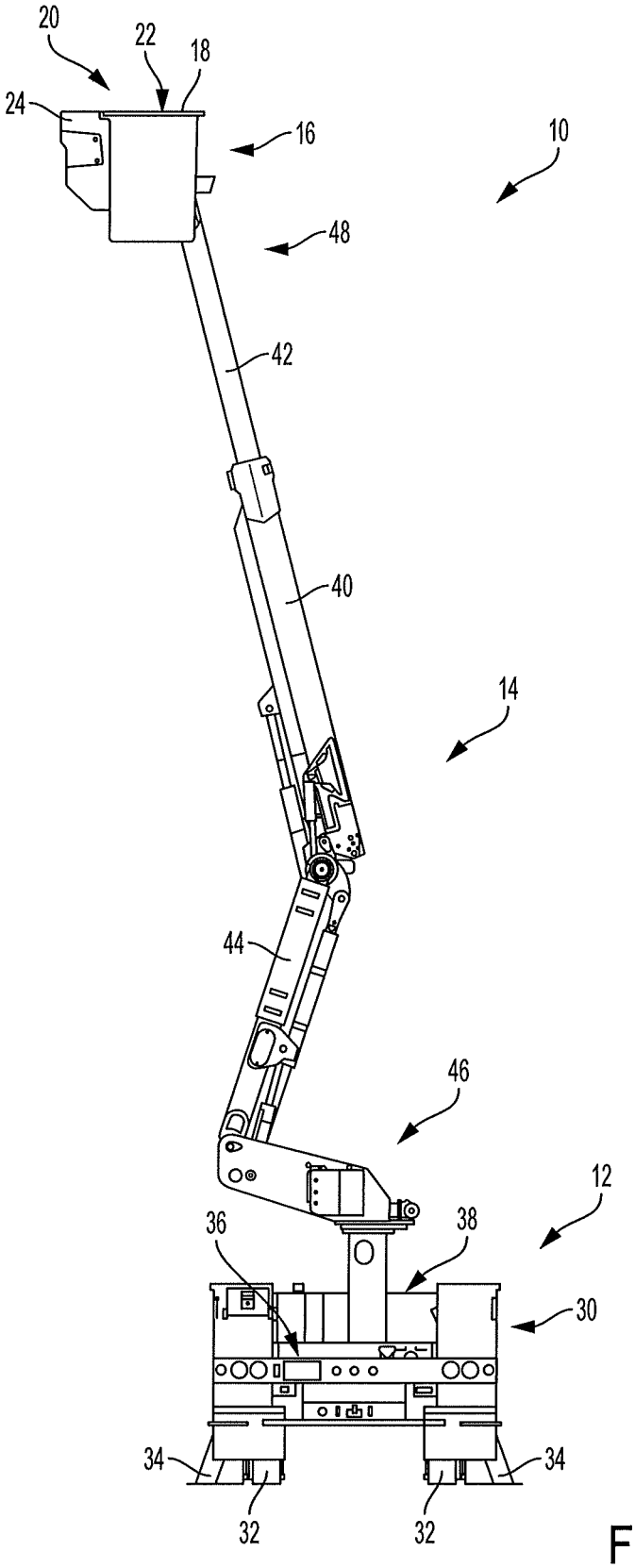
FIG. 1 is a rear view of an aerial device with a base, a boom assembly, and a utility platform assembly.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

An aerial device 10, constructed in accordance with various embodiments of the invention, is shown in FIG. 1. The aerial device 10 generally comprises a base 12 with a boom assembly 14 rotatably mounted thereto. A utility platform assembly 16 is disposed on the boom assembly 14 to provide an aerial platform for the accomplishment of a task by a utility worker. The utility platform assembly 16 broadly comprises a utility platform 18 with a lighting system 20 therein. The lighting system 20 provides light to a cavity 22 of the utility platform 18, and may also provide light to a set of upper boom controls 24, a platform lip 26 of the utility platform 18, and a step 28 of the utility platform 18.

The base 12 of the aerial device 10 is a selectively stabilized platform. In embodiments of the invention, the base 12 is a utility truck (as illustrated in FIG. 1), a crane base 12, an oilrig, an earth-working machine, or a fixed structure. The base 12 provides stability and a counterweight to a load being supported by the boom assembly 14 (such as the utility worker in the utility platform assembly 16). The base 12 comprises a chassis 30, a set of wheels 32, and a set of outriggers 34. The chassis 30 of the base 12 provides structural support for the aerial device 10. The chassis 30 may present a deck 36 upon which an operator can stand, and a cab 38 from which the operator can drive the aerial device 10. The set of outriggers 34 is for supporting and stabilizing the chassis 30 while the boom assembly 14 is being utilized.

In embodiments of the invention, the boom assembly 14 broadly comprises an outer boom section 40 and an inner boom section 42. In some embodiments, the boom assembly 14 may further comprise at least one pivoting boom section 44. The boom assembly 14 presents a general proximal end 46 and a general distal end 48. The proximal end 46 is rotatably and/or pivotably secured to a portion of the base 12. The distal end 48 is secured to the utility platform assembly 16. The inner boom section 42 is at least in part disposed within the outer boom section 40. The at least one inner boom section 42 telescopes to extend or retract into the outer boom section 40. The pivoting boom section 44 does not telescope out of any other boom section. Instead the pivoting boom section 44 rotates about the base 12, and the first boom section pivots and/or rotates relative to the pivoting boom section 44. The use of the pivoting boom section 44 allows the utility platform assembly 16 to reach certain areas and avoid obstacles in the working environment. In some embodiments, not illustrated, the boom assembly 14 comprises and outer boom section 40 and a pivoting boom section 44 without an inner boom section 42. In some embodiments, not illustrated, the pivoting boom section 44 comprises a lower outer boom section and a lower inner boom section.

In embodiments of the invention, the utility platform assembly 16 broadly comprises the utility platform 18, the lighting system 20, and the set of upper boom controls 24. The utility platform assembly 16 is configured to be added to the distal end 48 of the boom assembly 14. The utility platform assembly 16 allows the utility worker to perform various tasks from the elevated position. The set of upper boom controls 24 allows the utility worker to manipulate the boom assembly 14, the utility platform 18, and other tools. The lighting system 20 illuminates the cavity 22 of the utility platform 18, the exterior of the utility platform 18, the cavity 22 of the set of upper boom controls 24, etc. In some embodiments, the utility platform assembly 16 further comprises an insulative liner 50 disposed at least in part within the utility platform 18 to provide additional electrical isolation.

The utility platform 18 provides an elevated surface from which at least one utility worker can perform a task. As illustrated in FIGS. 2-7A, embodiments of the utility platform 18 comprise four platform sidewalls 52 and a platform floor 54 that collectively form a cavity 22. The utility platform 18 may also present the platform lip 26 along a top portion of at least one platform sidewall. The utility platform 18 may also comprise a lanyard anchor 56 for a lanyard worn by the utility worker. The utility platform 18 may further comprise the step 28 and/or a door (not illustrated) in at least one of the platform sidewalls 52 to allow for ingress and egress of the utility worker. The utility platform 18 may also comprise a handrail (not illustrated).

The four platform sidewalls 52 and the platform floor 54 of the utility platform 18 form the cavity 22. The four platform sidewalls 52 may be unitary, i.e. formed of a single monolithic structure, or they may be coupled together. The transition between successive platform sidewalls 52, and/or between the platform sidewalls 52 and the platform floor 54, may be rounded or arcuate.

In some embodiments, the utility platform 18 presents a horizontal cross-section that is substantially rectangular, such as illustrated in FIGS. 2-6. Thus, two of the opposing platform sidewalls 52 may have a greater width than the other two opposing platform sidewalls 52. In other embodiments, such as illustrated in FIG. 7A, the utility platform 18 presents a horizontal cross-section that is substantially square. Although the dimensions of the utility platform 18 may vary widely, an exemplary small one-worker platform has a horizontal cross-section of approximately 24 inches square (or 576 square inches, illustrated in FIG. 7A). A large one-worker platform (also known as a "man-and-a-half" platform) is approximately 24 inches by approximately 30 inches (or 720 square inches, illustrated in FIGS. 2-6). An exemplary platform for two utility workers has a horizontal cross-section of approximately 24 inches by approximately 48 inches (or 1,152 square inches, not illustrated). Each of the exemplary platforms has a height of approximately 42 inches. Other embodiments of the utility platform 18 may be other shapes about the horizontal cross-section, such as an ellipse, a circle, a D-shape, a triangle, a trapezoid, a rhombus, or other quadrilateral.

Figure 3:
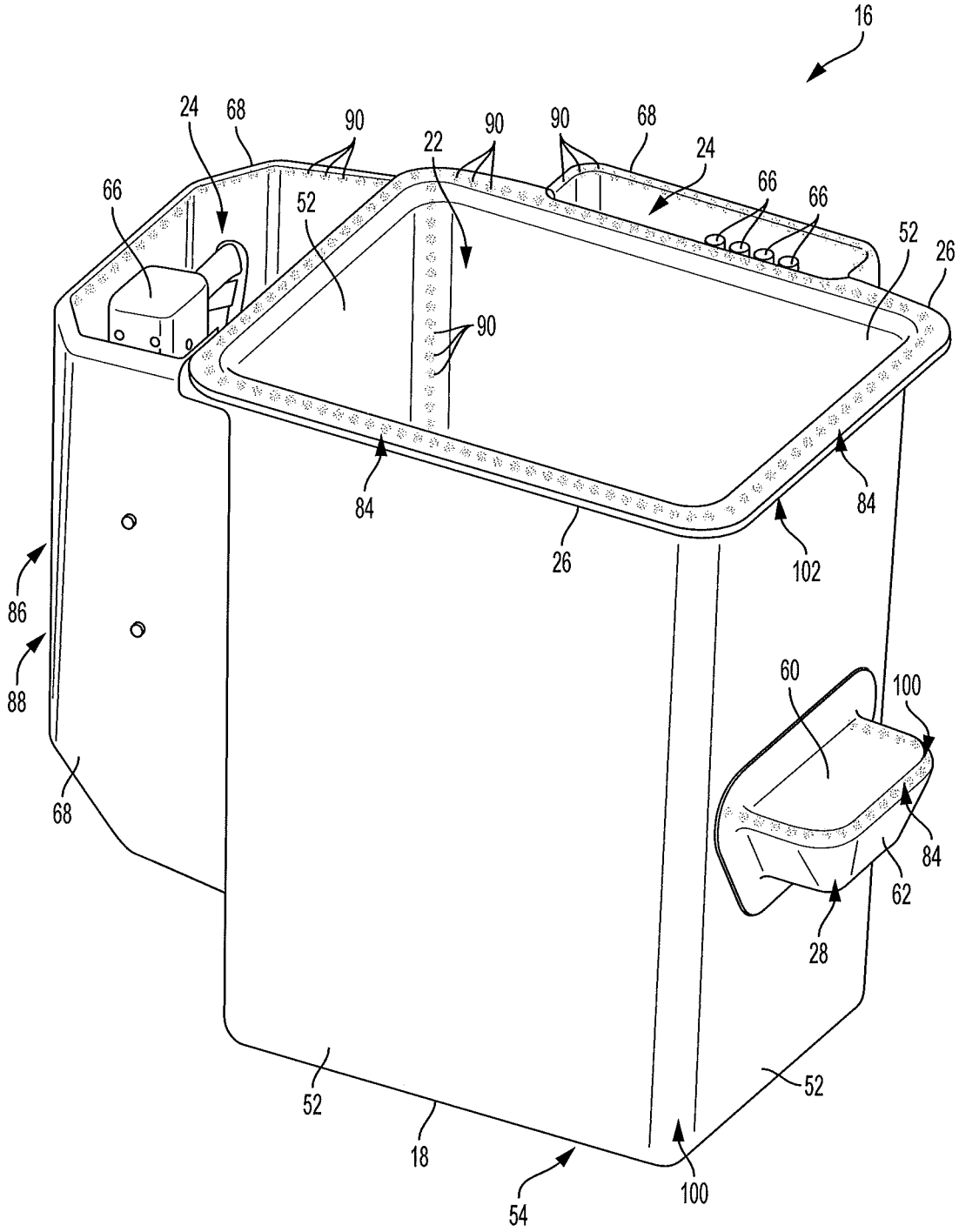
FIG. 3 is a perspective view of the utility platform assembly as viewed from a second direction, so as to illustrated a step on the utility platform.
Figure 4:
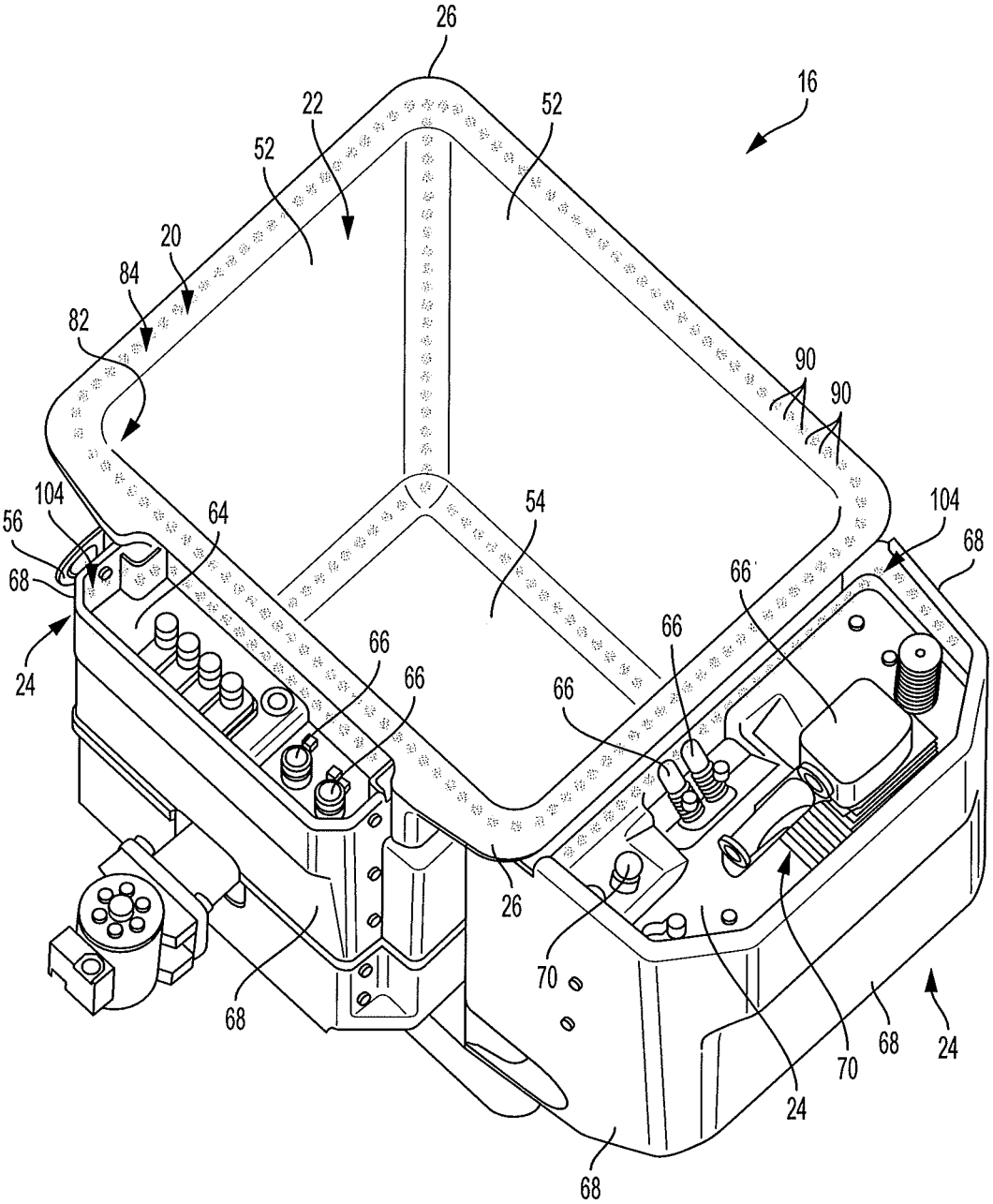
FIG. 4 is a perspective view of the utility platform assembly as viewed from a third direction, so as to illustrate a floor of the utility platform.
Figure 5:
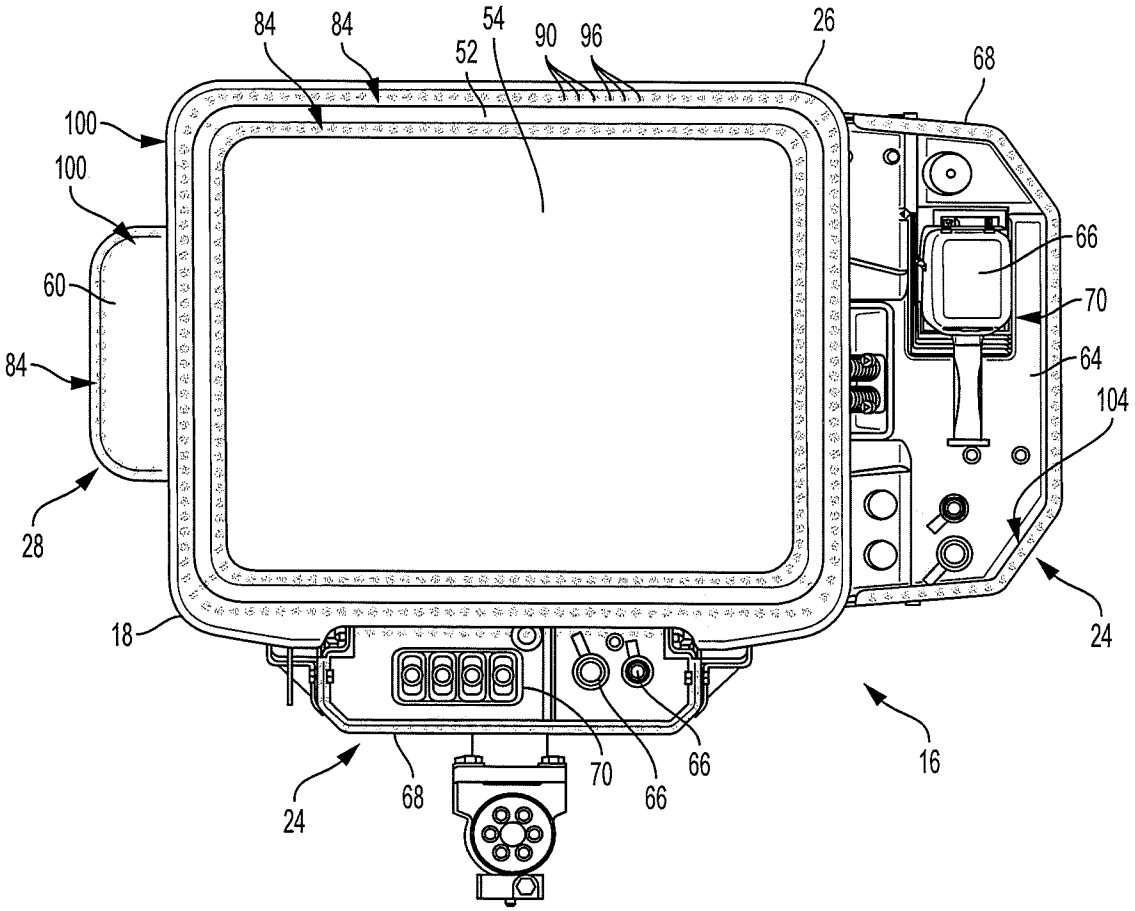
FIG. 5 is a top view of the utility platform assembly, illustrating an embodiment of the invention in which sidewalls, floor, and upper boom controls of the utility platform are illuminated by the lighting system.

Embodiments of the utility platform 18 present the platform lip 26 at a top edge 58 of at least one platform sidewall, as illustrated in FIG. 5. The platform lip 26 of the utility platform 18 provides stability and strength to the platform sidewalls 52 of the utility platform 18. The platform lip 26 extends laterally, i.e., perpendicular to the platform sidewall. The platform lip 26 presents a width from which it extends laterally from the respective platform sidewall. In embodiments of the invention, the platform lip 26 is continuous around all the platform sidewalls 52, as illustrated in FIG. 2-7A.

Embodiments of the invention present the step 28 along one of the sidewalls, as illustrated in FIGS. 3 and 5-7A. The step 28 is placed along the vertical sidewalls so as to allow the utility worker to step 28 up into or down out of the utility platform 18. The step 28 comprises a top surface 60 and a lower support 62. The step 28 extends laterally from the sidewall such that a worker ingressing or egressing from the utility platform 18 is provided with a convenient structure to step onto.

The set of upper boom controls 24 is best illustrated in FIGS. 2 and 4-6. The set of upper boom controls 24 comprises a dash cover 64, at least one input 66, and an outer wall 68. In various embodiments of the invention, the input 66 can be a valve handle, a joystick, a button, a switch, or a combination thereof. The dash cover 64 is generally flat or arcuate and presents at least one opening 70. Each of the at least one opening 70 is situated around each of the at least one input 66. The dash cover 64 may additionally contain written instructions, safety information, and displays.

The outer wall 68 encapsulates the set of boom controls (which may include hydraulic valves, batteries, and other components below the dash cover 64). The outer wall 68 prevents inadvertent striking of the set of upper boom controls 24. This prevents damage and unintentional selection, pressing, or manipulation of the set of upper boom controls 24. Because the outer wall 68 surrounds the set of upper boom controls 24, the set of upper boom controls 24 can be difficult to read or see in low-light situations.

Figure 7B:
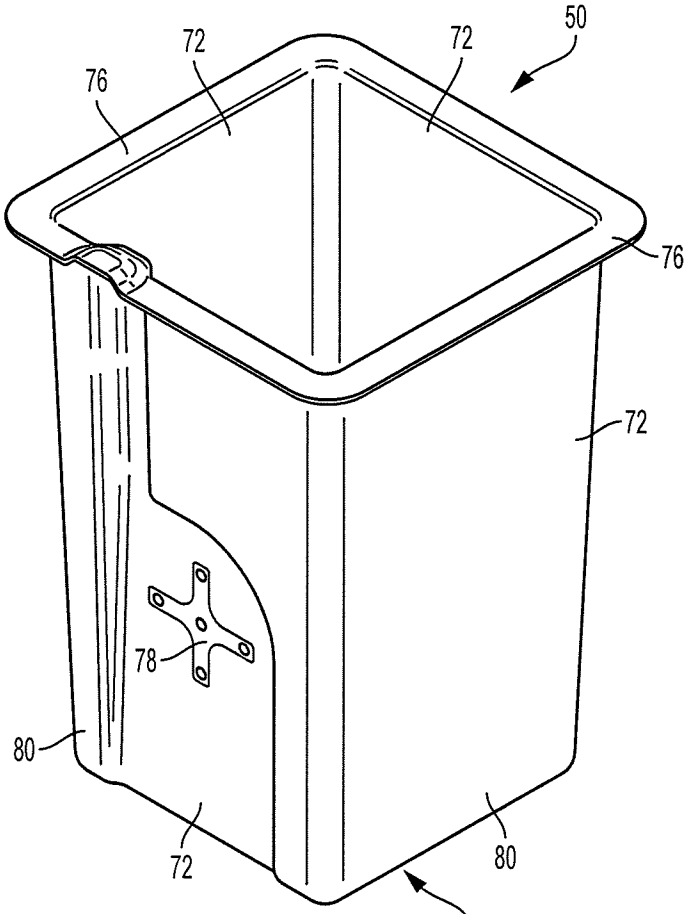
FIG. 7B is a perspective view of an insulative liner configured to fit within the utility platform of FIG. 7A.

Turning to FIG. 7B, in some embodiments of the invention the insulative liner 50 is disposed within the utility platform 18. The insulative liner 50 provides additional dielectric isolation of the utility worker from the utility platform assembly 16. The insulative liner 50 helps ensure that any discharge of electricity does not travel through the utility worker in discharging. The insulative liner 50 generally presents a shape that is complementary to the shape presented by the cavity 22 of the utility platform 18.

Embodiments of the insulative liner 50 comprise four liner sidewalls 72 and a liner floor 74, as illustrated in FIG. 7B. Some embodiments of the insulative liner 50 further comprise a liner lip 76 and a lanyard anchor 78. The four liner sidewalls 72 may be coupled to one another along opposing vertical edges to form the same aspect ratio (rectangle, square, or other shape) as the utility platform 18 in which the insulative liner 50 will be placed. In embodiments, the liner sidewalls 72 and/or liner floor 74 may be formed as a unitary or monolithic structure. Generally, an outer surface 80 of the liner floor 74 and the four liner sidewalls 72 has the same or slightly smaller dimensions as an interior surface 82 of the platform floor 54 and the platform sidewalls 52. Embodiments of the insulative liner 50 are formed of polyethylene. Other embodiments of the insulative liner 50 are formed of polyurethane or other polymer.

Figure 8:
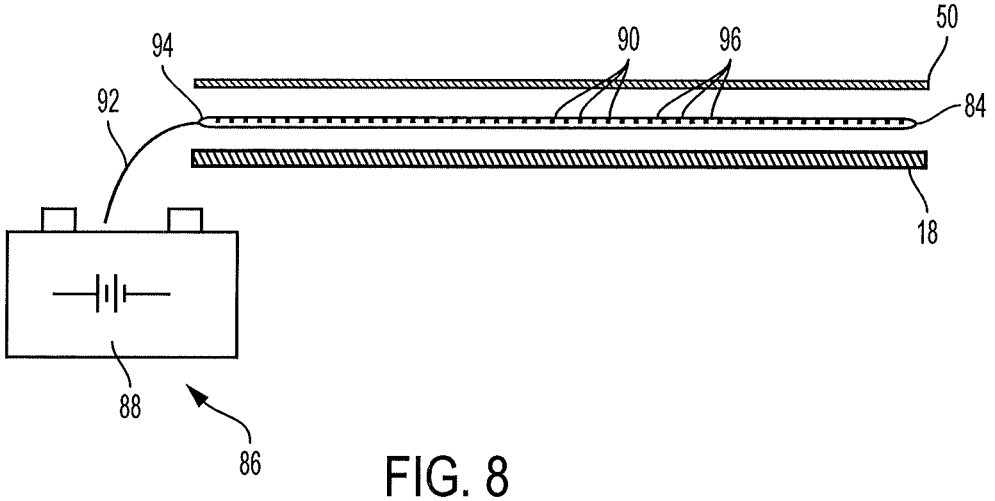
FIG. 8 is a schematic view of the lighting system being disposed between the utility platform and the insulative liner.

Now that the various components of the aerial device 10 have been described in detail, the lighting system 20 will now be discussed. The lighting system 20 is disposed within or adjacent to the utility platform assembly 16 so as to provide lighting within and in the area around the utility platform 18. The lighting system 20 broadly comprises a rope light 84 and a power source 86, as illustrated in FIG. 8. The rope light 84 is disposed in, on, or adjacent to the utility platform 18 so as to shine into at least the cavity 22 of the utility platform 18, and may be covered by the insulative liner 50 as illustrated. This allows utility workers to see within the utility platform 18 to grasp tools, repair parts, and the like from within the utility platform 18 during low-light situations. The power source 86 provides electrical current and/or light to the rope light 84, such that light can be emitted by the rope light 84. The power source 86 could be a battery 88, a light source (not illustrated), a hydraulic generator (not illustrated), or the like.

Figure 9:
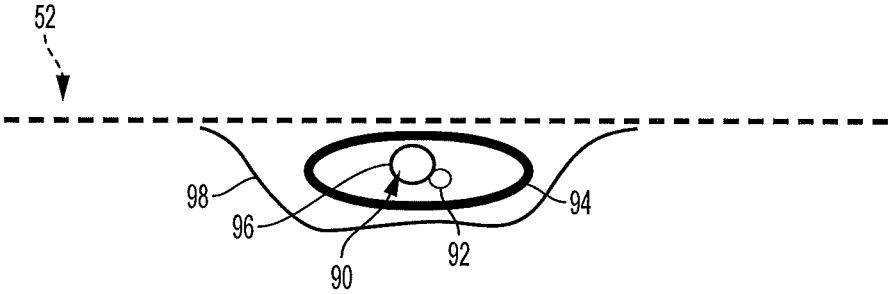
FIG. 9 is a schematic view of a vertical cross-section through the lighting system and illustrating a channel in the utility platform through which the lighting system is disposed.

In embodiments of the invention, the rope light 84 comprises a plurality of light emitters 90, a wire 92, and a jacket 94. The light emitters 90 are spaced along the wire 92, as illustrated in FIG. 8. The light emitters 90 and the wire 92 are encased in the jacket 94, as illustrated in FIG. 9. The light emitters 90 shine their light through the casing such that is can be seen by an observer. The jacket 94 may obscure or otherwise spread out the light such that the light appears to be emitting along a length of the jacket 94. This provides light over a linear area as opposed to at a single point (as is common in the headlamp of the utility worker or spotlights). Thus, gentle lighting is provided over an area so as to assist the utility worker in seeing within the utility platform 18 (or other area, as described below).

The jacket 94 may also be opaque so as to fully block the emission of light in certain directions or areas. For example, in embodiments of the invention, the jacket 94 may be translucent toward the cavity 22 of the utility platform 18 and opaque toward the exterior of the utility platform 18. As another example, the jacket 94 may be reflective toward the exterior of the utility platform 18, such that light emitted toward the exterior is reflected back so as to shine toward the cavity 22 of the utility platform 18. In this way, no light is lost on an opaque surface of the jacket 94. As such, in various embodiments of the invention, the rope light 84 may be omni-directional (i.e., emitting light in substantially all directions from the light emitter 90) or directional (i.e., emitting light in a restricted area). In some embodiments, a portion of the jacket 94 is opaque in all directions, such as in an area where no light is desired.

In embodiments of the invention, the light emitters 90 are light emitting diodes 96 ("LEDs"). LEDs 96 provide light utilizing relatively small amounts of power. The LED 96 is a two-lead semiconductor light source that emits light when activated. When a suitable voltage is applied to the leads from the battery 88 via the circuit board, electrons are able to recombine with electron holes within the LED 96, releasing energy in the form of photons. This effect is called electroluminescence, and the color of the light (corresponding to the energy of the photon) is determined by the energy band gap of the semiconductor. An LED 96 is often small in area (e.g., less than 1 $mm^2$) and integrated optical components may be used to shape its radiation sequence. In some embodiments, the LEDs 96 are uni-directional. In other embodiments, the LEDs 96 are omni-directional. A housing may funnel the light from the LEDs 96. In other embodiments, each LED 96 is directly linked to an individual component of the light-emitting segment. Additionally, the LEDs 96 may be soldered (or otherwise secured) directly at the edge of the circuit board so as to reduce wiring. The LEDs 96 themselves generate the color of the light (i.e., the color is not providing by covering the LED 96 is a certain color coating or covering). LEDs 96 also produce relatively little heat.

In other embodiments, the light emitters 90 are incandescent bulbs. In these embodiments, the bulbs will typically produce white (or substantially white) light that can then be changed using a colored filter. Incandescent bulbs typically draw more power than LEDs 96.

In still other embodiments, the light emitters 90 are a distal end of an optical fiber. In these embodiments, the light emitters 90 do not generate the light but instead emit the light that was generated at another location (such as near the set of upper boom controls 24 or at the base 12 of the aerial device 10). The optical fiber therefore redirects the light from the light source to the distal end for emission.

Regardless of the type of light emitter 90, in embodiments of the invention the light generated is red (or substantially red, e.g., with a wavelength in the range of 620 to 750 nm). Certain photoreceptor cells in the human eye, known as rod cells, function in less light than other photoreceptor cells, known as cone cells. Rod cells are almost entirely responsible for human vision at night. Rod cells, and specifically a rhodopsin receptor protein therein, are insensitive to red light. As such, shining a red light into the human eye will only slowly deplete the rhodopsin stores in the rod cells. This allows the rod cells to be able to see clearly at night during and after the red light is shone into them.

As such, the light generated by the light emitters 90 within the rope light 84 may be red or substantially red in embodiments of the invention. This allows the utility worker to retain his or her night vision so as to be able to still clearly see the worksite during and after being exposed to the red light coming from the various components of the utility platform 18, as discussed below.

In other embodiments of the invention, the light generated has a wavelength in a range of 300 nm to 500 nm to duplicate natural sunlight. In still other embodiments of the invention, the light generated is in a range of 380 nm to 800 nm to be within the visible spectrum. In still other embodiments, the light generated is in the ultraviolet and/or infrared spectrums, so as to be visible via night vision devices worn by the utility worker.

The wire 92 provides the light or power to the light emitters 90. In embodiments of the invention, the wire 92 is an electrical wire for carrying the current that the LED 96 or incandescent bulbs converts into light. It should be appreciated that in these embodiments, the wire 92 is shielded so as to prevent the discharge of electricity. The wire 92 may be electrically shielded. The shielding may be immediately surrounding the wire 92, may be the jacket 94, may be the insulative liner 50, or may be some combination thereof. In other embodiments, the wire 92 is an optical fiber such that the wire 92 provides light instead of electrical current. The optical fiber runs from the power source 86 to the light emitter 90.

In embodiments of the invention, at least a portion of the rope light 84 is configured to be installed on the interior surface 82 of the utility platform 18. In these embodiments, the rope light 84 is installed, placed, or otherwise secured within the utility platform 18. The rope light 84 therefore provides direct lighting to the cavity 22 of the utility platform 18 (and/or other areas, as discussed below). In embodiments of the invention, the rope light 84 is disposed on the interior surface 82 of the utility platform 18 and the power source 86 is disposed externally to the utility platform 18 (such as within the outer wall 68 of the set of upper boom controls 24). This allows the power source 86 be accessed externally (e.g., so as to change or charge the battery 88) and prevents the power source 86 from being a physical obstruction within the utility platform 18.

The rope light 84 may be secured or installed in various ways. For example, the rope light 84 may be secured within the utility platform 18 by placing the insulative liner 50 thereover (as discussed below). As another example, the rope light 84 may be secured within the utility platform 18 via a chemical adhesive. As still another example, the rope light 84 may be secured in the utility platform 18 via a mechanical fastener (such as an ISOPLAST screw). In yet further embodiments, the rope light 84 may be secured in the utility platform 18 by forming the utility platform 18 at least in part around the rope light 84. As such, the rope light 84 may be added into the utility platform 18 during the manufacturing of the utility platform 18 (such that the utility platform 18 at least in part encases the rope light 84 so as to secure the rope light 84 therein).

In embodiments of the invention, the rope light 84 is installed or placed into a channel 98 (or groove or recess) in the utility platform 18, as illustrated in FIG. 8. As discussed above, the utility platform 18 sidewalls and floor present a thickness. The channel 98 may therefore be carved or formed into the thickness of the sidewall or floor. The rope light 84 can then be placed into the channel 98. In this way, the rope light 84 is installed into the interior surface 82 of the utility platform 18 but does not substantially protrude or extend up into the cavity 22. Protrusions or extensions into the cavity 22 could present tripping or snagging hazards and/or make the rope light 84 susceptible to damage.

In some embodiments of the invention, the channel 98 is added into an existing utility platform 18. In this way, the utility platform 18 can be retrofitted to include the lighting system 20. However, in some instances, the channel 98 may introduce structural strength and stability issues into existing utility platforms 18. The utility platform 18 may therefore have a thickness that is generally greater than a thickness of a comparable utility platform 18 without a lighting system 20.

In other embodiments (not illustrated), instead of a channel 98 being formed by removing material, the channel 98 is formed by adding additional material to the respective sides of the channel 98. The channel 98 is therefore built up around where the rope light 84 is intended to be emplaced. In still other embodiments, there is no channel 98 used and instead the rope light 84 is emplaced only in the corners of the utility platform 18 (e.g., between adjacent sidewalls, between a bottom end of the sidewall and the floor, etc.). In this way, the rope light 84 presents no or a minimal tripping or snagging hazard as it is recessed in and protected by the corner.

In still other embodiments (not illustrated), the channel 98 is formed in the insulative liner 50. The insulative liner may therefore be formed so as to receive the rope light 84 therein. The channel 98 in the insulative liner 50 may be formed along the corners, or in another shape such as discussed below. The insulative liner 50 may include additional thickness and protection adjacent to the channel 98. A method of installing the lighting system may include the steps of inserting the rope light 84 within the insulative liner 50; inserting the insulative liner within the utility platform assembly 16; and attaching the rope light 84 to the power source 86.

In embodiments of the invention, the rope light 84 is disposed in the utility platform assembly 16 in a pattern. Patterns are designed to provide optimal lighting while economically using the rope light 84. It should be appreciated that economical use of the rope light 84 would be advantageous, especially in embodiments that utilize a battery 88 as the power source 86. One example of a pattern, as can be seen in FIG. 2-5, is a box pattern. In the box pattern, the rope light 84 outlines the cavity 22 of the utility platform 18 by being substantially along the interior corners of the utility platform 18. This provides light over a large area.

Another example of a pattern is the spiral. In the spiral pattern (not illustrated), the rope light 84 begins on an upper side of the utility platform 18 and spirals downward along the sidewalls toward the floor. The spiral adds simplicity to the design such that only a single continuous rope light 84 is used and need not be intersected or split.

Figure 6:
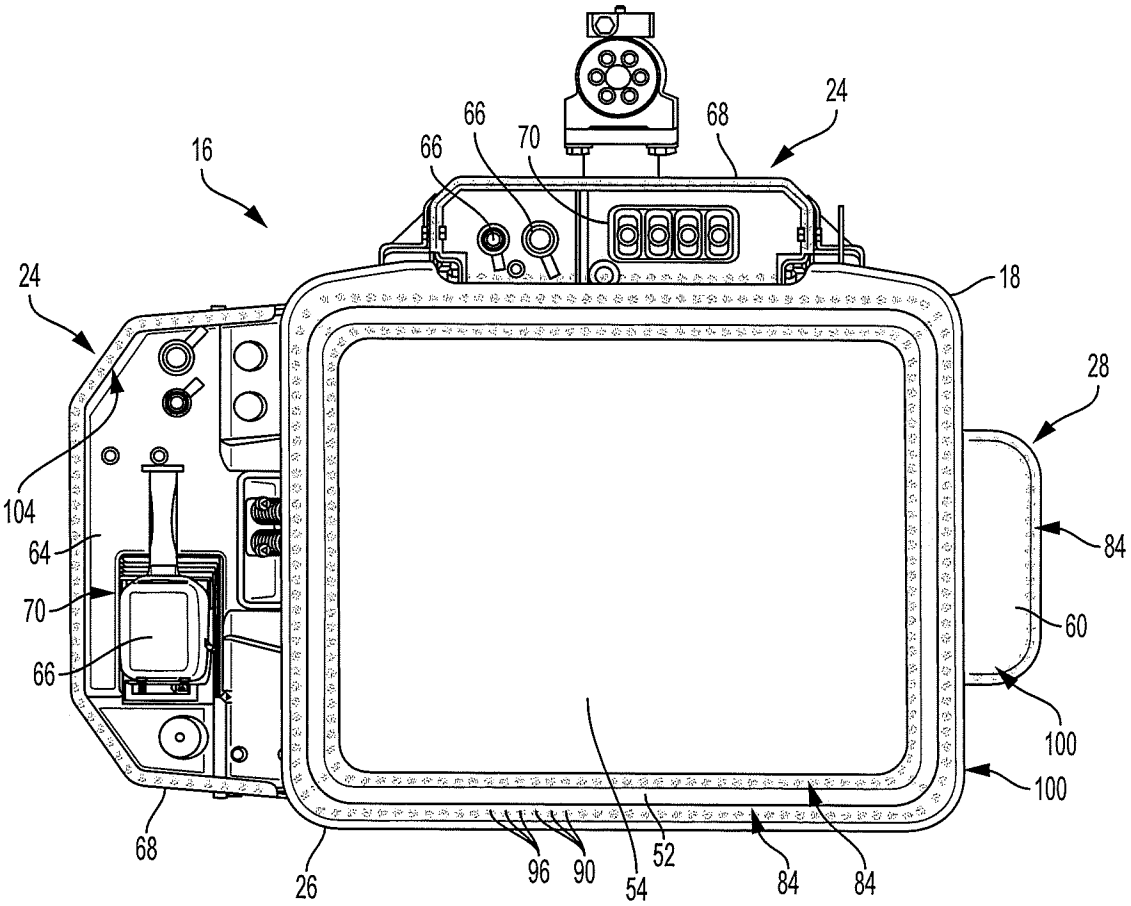
FIG. 6 is a top view of the utility platform assembly, illustrating an embodiment of the invention in which only the floor is illuminated by the lighting system.
Figure 7A:
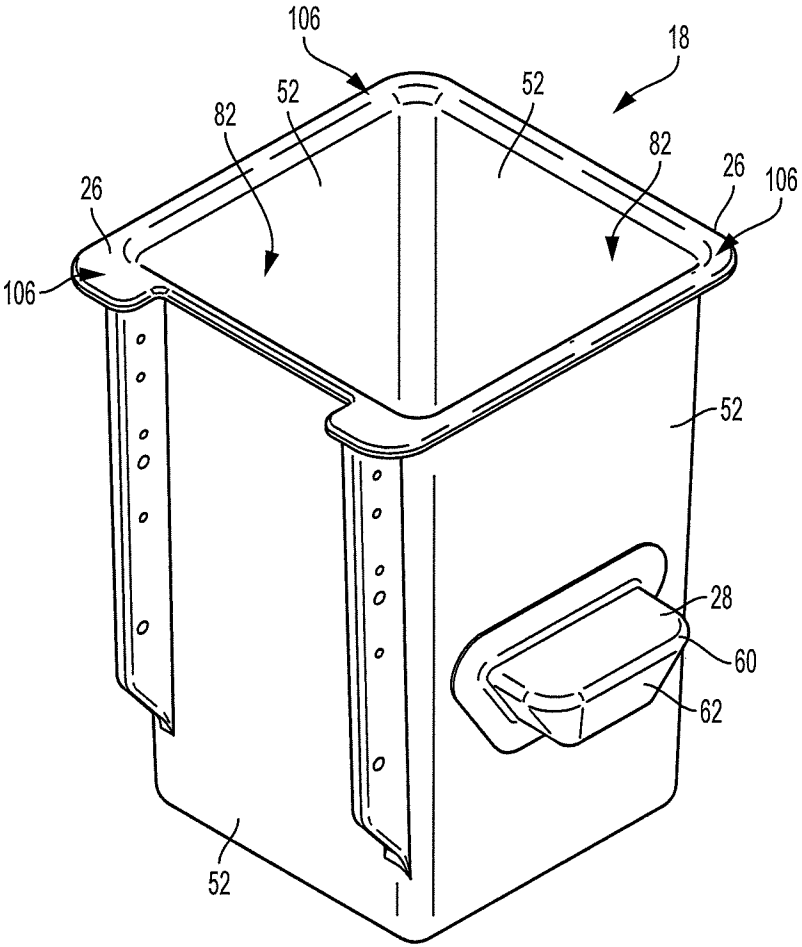
FIG. 7A is a perspective view of another embodiment of a utility platform.

Yet another exemplary pattern is a floor outline, as illustrated in FIG. 6. The floor outline is similar to the box pattern, but only outlines the corners along the bottom side of each sidewall. Yet further examples of patterns could include asymmetrical patterns. These patterns may include rope light 84 along working sides of the cavity 22 (i.e., toward the normal direction or directions to which the utility worker faces) and no or less rope light 84 along non-working sides. This allows greater light saturation where the utility worker will be working and less light toward sides that will be less useful. Other patterns would also be within the scope of the invention, and these patterns are only given and illustrated for exemplary purposes.

In embodiments of the invention, at least a portion of the rope light 84 is configured to be covered by the translucent insulative liner 50, as illustrated in FIG. 8. As discussed above, the insulative liner 50 provides additional insulation and isolation of the utility worker within the utility platform 18. The insulative liner 50 may therefore be placed installed directly atop the rope light 84 of the lighting system 20. The rope light 84 (or at least a portion of the rope light 84) will therefore be disposed between insulative liner 50 and the respective sidewall or floor of the utility platform 18. The insulative liner 50 will therefore keep the rope light 84 secure in the position in which it was placed. The insulative liner 50, as discussed above, presents a complementary shape to the cavity 22 of the utility platform 18. This complementary shape may also be complementary to at least a portion of the lighting system 20.

In embodiments of the invention, the insulative liner 50 is substantially translucent. This allows the light from the rope light 84 to pass through the insulative liner 50 such that it can be observed by the utility worker. The insulative liner 50 will therefore spread the light, such that the light appears to cover a larger area. The insulative liner 50 will therefore make the lighting appear softer (i.e., less bright from each specific light emitter 90). This helps to conserve the utility worker's ability to see at night. In embodiments of the invention, the sidewalls and the floor of the utility platform 18 are substantially opaque. In these embodiments, for example, the rope light 84 may be omni-directional In some embodiments of the invention, at least a portion of the rope light 84 is configured to be installed on an exterior surface 100 of the utility platform 18, such as illustrated in FIG. 3. In some embodiments, the rope light 84 is oriented such that at least a portion of the light is emitted through sidewalls and/or floor (i.e., into the cavity 22). In other embodiments, the rope light 84 is oriented such that at least a portion of the light is emitted outward. This outward-facing light may be oriented upward, downward, or laterally. In some embodiments, the rope light 84 is configured to emit light both into the cavity 22 and externally to the utility platform 18. In these embodiments, the rope light 84 provides light to aid visibility from the ground and to illuminate the work area, in addition to illuminating the cavity 22 of the utility platform 18.

In embodiments of the invention, the rope light 84 is secured to the exterior of the utility platform 18 and configured such that at least a portion of the light is transmitted through the sidewall and/or the floor of the utility platform 18 (so as to be visible from the cavity 22 of the utility platform 18). In these embodiments, the utility platform 18 may be translucent or transparent so as to allow the light to pass through the utility platform 18. The light may also be visible from the exterior of the utility platform 18.

In embodiments of the invention, the rope light 84 is secured to a lower side 102 of the platform lip 26 of the utility platform 18 and configured so as to shine the light downward and laterally so as to illuminate the set of upper boom controls 24. In these embodiments, the set of upper boom controls 24 is illuminated from below the platform lip 26. This illuminates the set of upper boom controls 24 without shining a light directly into the eyes of the utility worker (which can cause temporary partial blindness in the utility worker).

Figure 2:
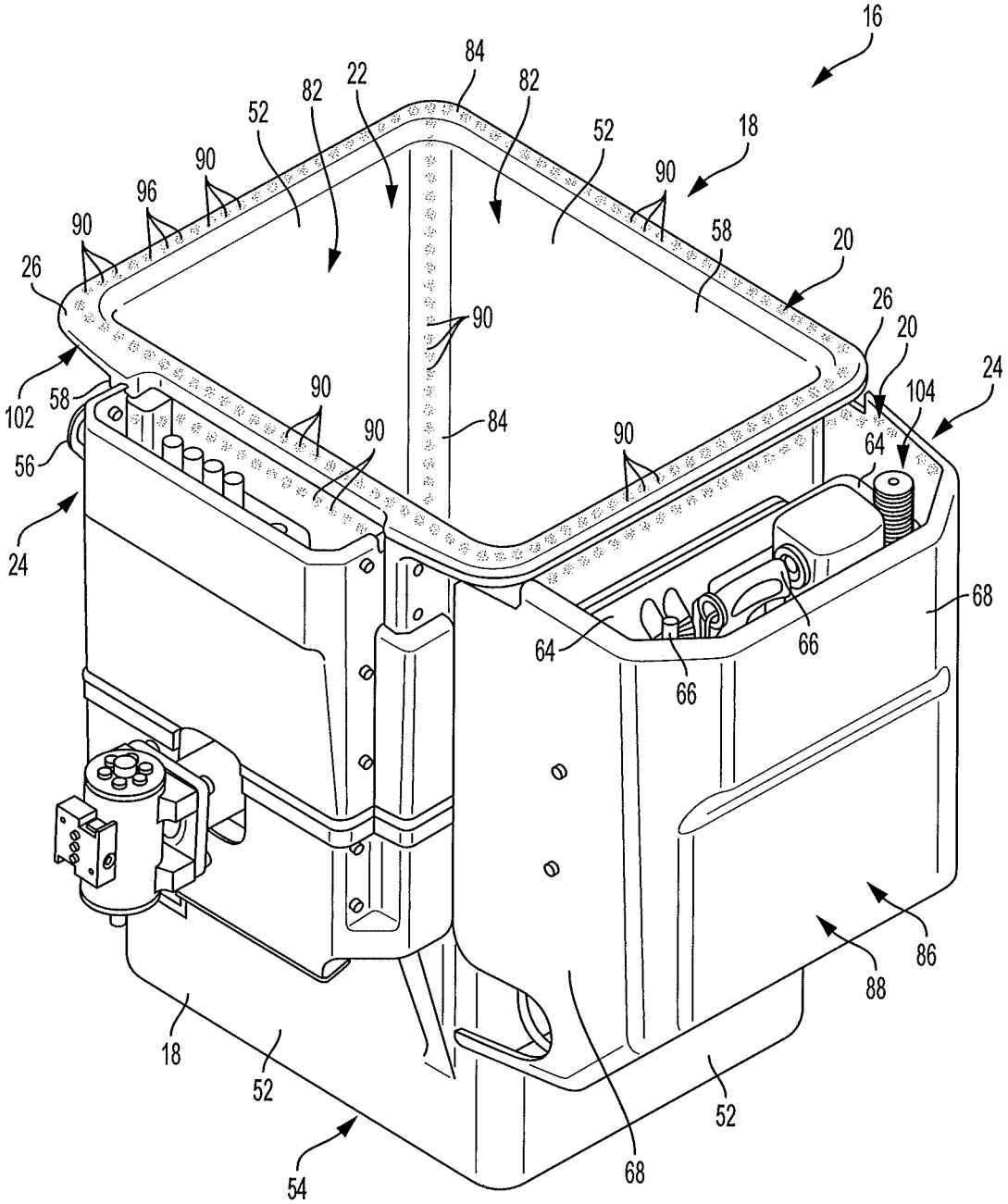
FIG. 2 is a perspective view of the utility platform assembly with a lighting system as viewed from a first direction.

In some embodiments of the invention, the set of upper boom controls 24 is further illuminated by rope lights 84 disposed along an inner surface 104 of the outer wall 68 of the set of upper boom controls 24, such as illustrated in FIGS. 2-4. The set of upper boom controls 24 of these embodiments is illuminated from substantially every direction. In this way, shadows being cast by the various boom controls are minimized. Shadows can obscure the utility worker's ability to clearly read the written labels of the controls, read indicators and sensors, etc.

In some embodiments of the invention, the rope light 84 is disposed along a top side 106 of the platform lip 26, as illustrated in FIGS. 2-5. In these embodiments, at least a portion of the light is emitted in an upward direction so as to illuminate a work area. As illustrated in FIGS. 2-5, the rope light 84 may be disposed along a circumference of the platform lip 26 such that the light is emitted upward and laterally upward all along the platform lip 26. This allows the work area to be gently and evenly lighted. It also reduces the shadows that can be imparted on the work area by the spotlights that are common in the prior art. The shadows are cast by the light being obstructed by the utility platform 18, the utility worker, the various components of the worksite, etc. The shadows can make seeing the various components of the worksite (which the utility worker is installing, repairing, replacing, or performing other tasks on) difficult, and may cause the utility worker to err in performing the task. This can be potentially dangerous.

In some embodiments of the invention, the rope light 84 is disposed on the step 28 and configured such that at least a portion of the light is oriented substantially upward from the step 28, as illustrated in FIGS. 3 and 5. The rope light 84 may outline the top surface 60 and/or the lower support 62. This allows the utility worker to clearly see the step 28. This provides the utility worker with a clear indication of where the step 28 is, so as to assist in the ingress and egress of the utility worker. Ingress and egress are typically performed near the ground. Nonetheless, ingressing into egressing out of the utility platform 18 can be potentially hazardous because the utility worker is often wearing protective clothing, which can make maneuvering over the platform lip 26 and the sidewall difficult. The utility worker may also be carrying tools, repair parts, and the like. The step 28 is therefore illuminated such that the utility worker can easily see the outline so as to allow the utility worker to easily step thereon during ingress and egress.

The power sources 86 of the lighting system 20 will now be discussed in greater detail. Power source 86 is electrically isolated from the base 12, such that an electrification of the power source 86 cannot discharge into the ground. The power source 86 either generates or acquires electrical power to be transferred to the rope light 84, such that the LEDs 96 (or other light emitters 90) in the rope light 84 can generate the desired light.

In some embodiments of the invention, the power source 86 is a battery 88, as illustrated in FIG. 8. The battery 88 may be stored in or near the set of upper boom controls 24. In these embodiments, the battery 88 is electrically isolated because it is not in electrical contact with the base 12 of the utility platform 18. Nonetheless, the battery 88 may be shielded or otherwise protected such that an electrified source (such as an electrical power line or the like) cannot cause an explosion by contacting the battery 88. For example, the battery 88 may be disposed within the outer wall 68 of the set of upper boom controls 24.

In some embodiments, the battery 88 is removable. As such, the operator can remove and recharge or replace the battery 88 as needed. For example, there may be a battery charger (not illustrated) in the base 12 of the utility platform 18. As such, the utility worker may swap the battery 88 in the power source 86 in the utility platform 18 with the battery 88 in the battery charger in the base 12. This allows the utility worker to easily and quickly remove and replace the battery 88 as needed. However, the utility worker would be required to lower the utility platform 18 to near ground level such that the utility worker can retrieve the battery 88.

In other embodiments, the battery 88 is recharged by a solar panel (not illustrated). The solar panel comprises a plurality of solar photovoltaic modules electrically connected to each other and mounted on a supporting plate. Most solar panels output direct current (DC) power, although some output alternating current (AC) power. Embodiments of the invention utilize solar panels in a variety of sizes and output ratings. The size of the solar panel may be based upon the availability of space to fit the solar panel on or near the utility platform 18. The output rating, which measures the output of the solar panel under standard conditions, may be based whether the battery 88 will be used to power additional tools and devices, in addition to the lighting system 20. The solar panel may be mounted on the exterior surface 100 of the utility platform 18 and/or the outer wall 60 of the set of upper boom controls 24.

In some embodiments of the invention, the power source 86 further includes a converter. The converter changes the form of the electric power to AC from DC, or to DC from AC. The converter may also be removable, such that the utility worker can engage the converter if necessary for the specific tool to be used to perform the specific task, beyond the lighting system 20.

The battery 88 stores at least a portion of the electric power produced by the solar panel. The battery 88 is located on or near the utility platform 18. In some embodiments, the battery 88 is a component of the power source 86. For example, the battery 88 may be stored internally within the power source 86 or may be itself the entirety of the power source 86. In other embodiments, the battery 88 is selectively removable. In some embodiments, the battery 88 is charged directly by the aerial device 10 or by a battery 88 charger at a headquarters location associated with the aerial device 10 prior to operations. In some embodiments, when in operation, the battery 88 is covered such that the utility worker (for safety reasons) cannot directly access it. In yet other embodiments, there is no battery 88 and generated electrical power is utilized directly or lost.

Various methods of the invention will now be discussed. A method of installing the lighting system 20 comprises following steps: installing a rope light 84 adjacent to the utility platform 18, wherein the rope light 84 is configured to emit a light via a plurality of light emitters 90 disposed along the rope light 84; and installing a power source 86 with the utility platform 18 such that the power source 86 is configured to provide electrical power to the rope light 84, wherein the power source 86 is electrically isolated so as to prevent a potentially hazardous discharge of electricity.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

Having thus described various embodiments of the invention, what is claimed as new and desired to be protected by Letters Patent includes the following:

1. A utility platform assembly comprising:

at least one sidewall;

a floor;

a lip, wherein the utility platform presents a cavity configured to support a utility worker therein;

at least one light for illuminating the utility platform, wherein the at least one light is configured to be attached to the utility platform, and an insulative liner covering at least a portion of the at least one light and providing electrical insulation, wherein the insulative liner comprises at least one insulative sidewall and at least one insulative floor for fitting within the utility platform cavity, wherein the insulative sidewall extends from the floor to the lip of the utility platform.

2. The utility platform assembly of claim 1, wherein the at least one light is at least partially disposed within a channel on the utility platform.

3. The utility platform assembly of claim 1, wherein the at least one light is a rope light encompassed on all sides by the insulative liner.

4. The utility platform assembly of claim 1,
wherein the at least one light is at least partially disposed within the at least one sidewall and floor,
wherein the insulative liner encompasses the utility platform on all sides and floor including the at least one light.

5. The utility platform assembly of claim 2, wherein the insulative liner covers at least a portion of the utility platform including the at least one light.

6. The utility platform assembly of claim 2, wherein the at least one light extends substantially the full length of the channel.

7. The utility platform assembly of claim 2,
wherein the insulative liner encompasses the utility platform,
wherein the at least one light is visible only on a portion not disposed within the utility platform and only the portion not disposed is covered by the insulative liner.

8. The utility platform assembly of claim 3,
wherein the at least one light is a rope light,
wherein the channel is disposed within a thickness of the sidewall.

9. The utility platform assembly of claim 3,
wherein the at least one light is a rope light,
wherein the channel is at least partially disposed within a thickness of the floor.

10. The utility platform assembly of claim 4, wherein the utility platform is configured to be installed on an aerial device.

11. A utility platform assembly comprising:
a sidewall;
a floor,
wherein the sidewall and the floor present a cavity,
wherein the cavity is configured to support a utility worker therein;
an insulative liner providing electrical insulation;
a lip,
wherein the insulative liner comprises at least one insulative sidewall and at least one insulative floor for fitting in the cavity,
wherein the insulative sidewall extends from the floor to the lip of the utility platform;
a rope light,
wherein the rope light is permanently secured to the sidewall within the cavity.

12. The utility platform assembly of claim 11,
wherein the rope light is at least partially covered by an insulative liner,
wherein the rope light is configured to illuminate at least the cavity of the utility platform.

13. The utility platform assembly of claim 11, wherein the utility platform assembly further comprises:
a set of upper boom controls; and
a second rope light,
wherein the second rope light is secured to the set of upper boom controls,
wherein the second rope light is configured to illuminate the set of upper boom controls.

14. The utility platform assembly of claim 11, further comprising:
a channel,
wherein the rope light is at least partially disposed within the channel; and
an insulative liner disposed over the sidewall, the floor, and the rope light,
wherein the rope light is configured to illuminate the cavity through the insulative liner.

15. A utility platform assembly comprising:
a sidewall;
a lip;
a floor,
wherein the sidewall and the floor present a cavity configured to support a utility worker therein;
at least one light,
wherein the at least one light is secured to at least one of the sidewall and the floor; and
an insulative liner covering at least a portion of the at least one light and providing electrical insulation,
wherein the insulative liner comprises at least one insulative sidewall and at least one insulative floor for fitting within the cavity,
wherein the insulative sidewall extends from the floor to the lip of the utility platform;
wherein the at least one light is at least partially disposed within at least one channel.

16. The utility platform assembly of claim 15, wherein the at least one channel is a recess disposed within a thickness of the at least one sidewall.

17. The utility platform assembly of claim 15, wherein the at least one channel is a recess disposed within a thickness of the floor.

18. The utility platform assembly of claim 15, wherein the at least one light is configured to illuminate the cavity.

19. The utility platform assembly of claim 16,
wherein the insulative liner covers the sidewall including the at least one light,
wherein the at least one light is secured with a chemical adhesive.

20. The utility platform assembly of claim 17,
wherein the insulative liner covers the floor including the at least one light,
wherein the at least one light does not protrude into the cavity,
wherein the at least one light is configured to illuminate the cavity.

* * * * *